US008253341B2

(12) United States Patent
Ku et al.

(10) Patent No.: US 8,253,341 B2
(45) Date of Patent: Aug. 28, 2012

(54) LIGHT EMITTING DIODE LAMP AND CONTROL CIRCUIT THEREOF

(75) Inventors: Chin-Long Ku, Taipei Hsien (TW); Chin-Wen Yeh, Taipei Hsien (TW); Zhi-Jian Peng, Shenzhen (CN); Hai-Shan Sun, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 314 days.

(21) Appl. No.: 12/626,687

(22) Filed: Nov. 27, 2009

(65) Prior Publication Data

US 2011/0089856 A1 Apr. 21, 2011

(51) Int. Cl.
*H05B 39/00* (2006.01)

(52) U.S. Cl. ..... 315/185 S; 315/247; 315/309; 315/291; 315/312

(58) Field of Classification Search ..... 315/247, 315/224, 291, 307–326, 185 S, 149–159
See application file for complete search history.

(56) References Cited

U.S. PATENT DOCUMENTS

2004/0251854 A1* 12/2004 Matsuda et al. ..... 315/291
2007/0224081 A1* 9/2007 Bokerman et al. ..... 422/56
2010/0320499 A1* 12/2010 Catalano et al. ..... 257/99

* cited by examiner

*Primary Examiner* — Tuyet Thi Vo
(74) *Attorney, Agent, or Firm* — Altis Law Group, Inc.

(57) ABSTRACT

A control circuit for controlling current through LEDs of an LED lamp includes a voltage regulator, a feedback circuit with an amplifier and a photo-resistor. The voltage regulator includes an output terminal connecting with the LEDs and a feedback terminal. The amplifier includes an in-phase input end coupling with an output end of the LEDs, an out-phase input end and an output end connected to the feedback terminal of the voltage regulator. The photo-resistor is connected between the out-phase input end of the amplifier and the ground. The photo-resistor has a resistance increasing along with a decrease of the light intensity of the LEDs. The increase of resistance of the photo-resistor is fed back to the voltage regulator via the amplifier, to thereby increase the electric current through the LEDs to maintain the light intensity of the LED lamp within an acceptable range.

7 Claims, 2 Drawing Sheets

LIGHT EMITTING DIODE LAMP AND CONTROL CIRCUIT THEREOF

BACKGROUND

1. Technical Field

The disclosure relates to light emitting diode lamps, and particularly to a control circuit for maintaining a luminous intensity of a light emitting diode lamp within an acceptable range in a long time.

2. Description of Related Art

Recently, light emitting diodes (LEDs) have become widely used in a variety of LED lamps, for example, miner's lamps, street lamps, submarine lamps and stage lamps, for their low power requirement and long lifetime. However, all LEDs present gradual luminous decay that is related to a driving current flowing therethough and a junction temperature thereof, and different LED designs present their own characteristic degradation rates.

With high-power LEDs, for example, in a high-power LED street lamp, along with an increased use time and a poor heat dissipation performance, a light output of the LEDs will gradually decrease due to the luminous decay, which is resulted in a luminous intensity of the LED street lamp greatly decreased. For road lighting, when the luminous decay is up to 30%, the lamps will not meet road illumination needs. That is, after a period of time, the LED street lamp cannot meet the lighting needs due to the luminous decay of the LEDs. The luminous decay of the LEDs results in a shortening of a life time of the LED street lamp below its actual serviceable time.

In order to obtain a longer life time, one way is to apply a larger driving current to the LED street lamp to drive the LEDs to emit light with a intensity higher than the rated, to thereby maintain a proper illumination of the LED street lamp even after a comparatively long period of time. However, the larger driving current through the LEDs causes excess of luminous flux output, which results in a waste of energy; on another aspect, this larger driving current accelerates luminous decay of the LEDs and causes damage to the LEDs.

It is thus desirable to provide an LED lamp with a control circuit which can overcome the described limitations.

DETAILED DESCRIPTION

Figure 1:
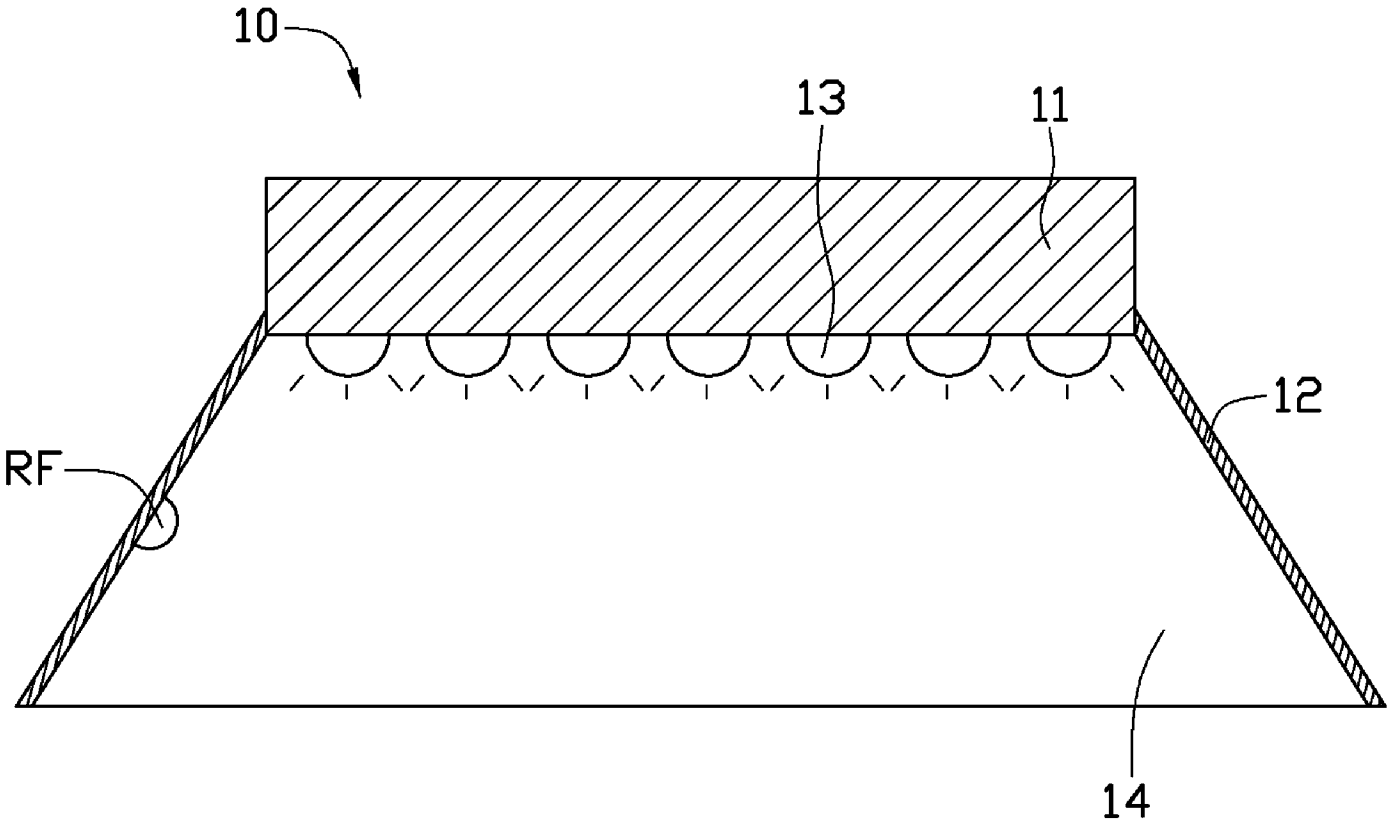
FIG. 1 is a schematic, cross-section view of a light emitting diode (LED) lamp according to an exemplary embodiment of the present invention.

Reference will now be made to the drawing figures to describe the present light emitting diode lamp in detail.

Referring to FIG. 1, a light emitting diode (LED) lamp 10 according to an exemplary embodiment of the disclosure is shown. The LED lamp 10 includes a lamp seat 11, a plurality of LEDs 13 mounted on a bottom side of the lamp seat 11 and a lampshade 12 covering around the LEDs 13. The lampshade 12 is hollow, conical frustum-shaped, and includes a first end connected to a periphery of the lamp seat 11 and an opposite second end far away from and below the lamp seat 11. The lampshade 12 defines a light exit 14 at the second end.

Figure 2:
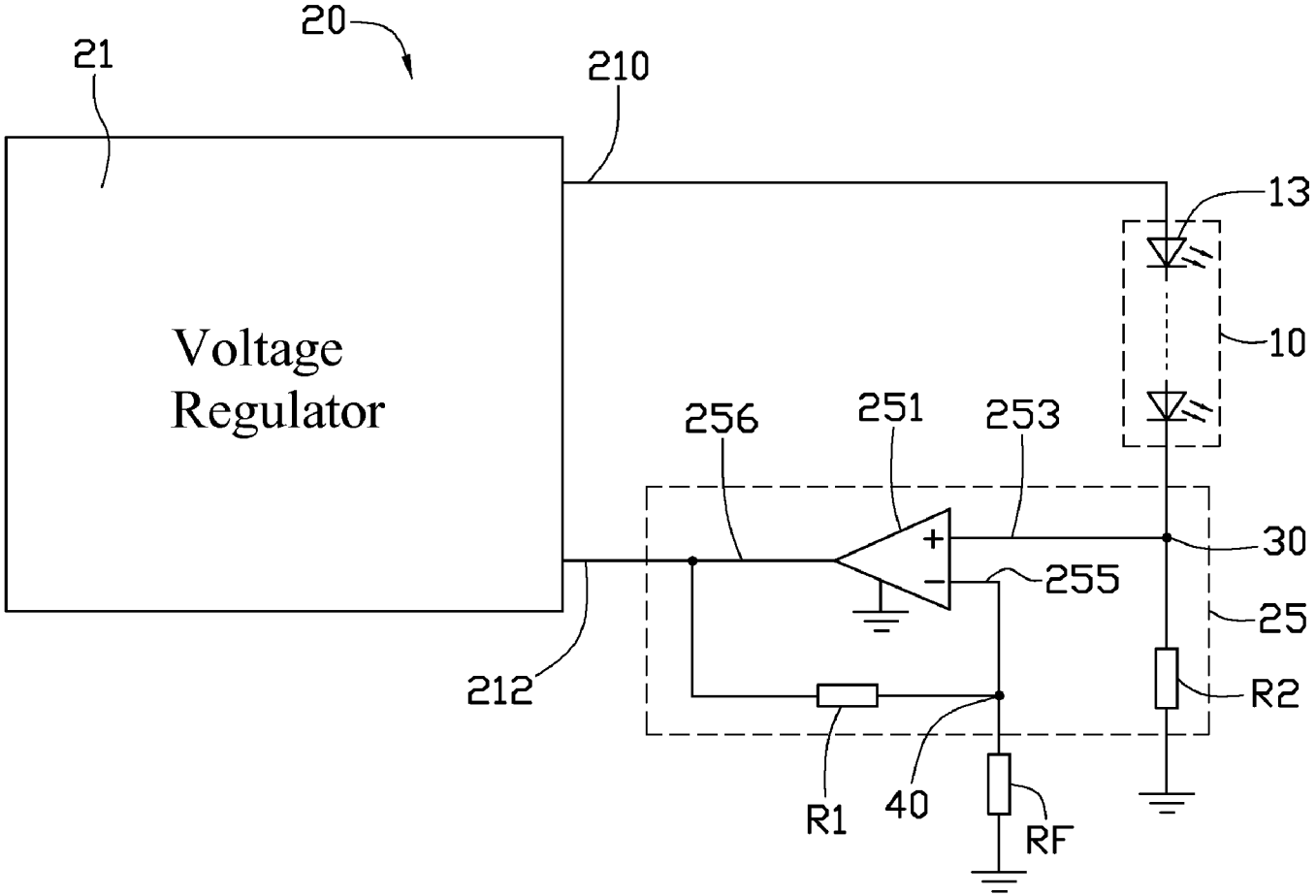
FIG. 2 is a schematic view of a control circuit of the LED lamp of FIG. 1.

Referring to FIG. 2, a control circuit 20 for supplying an electric current to the LEDs 13 of the LED lamp 10 to drive the LEDs 13 to emit light is shown. The control circuit 20 includes a voltage regulator 21, a photo-resistor RF and a feedback circuit 25. The photo-resistor RF is received in the lampshade 12 and mounted on an inner surface of the lampshade 12 at a position between the LEDs 13 and the light exit 14. When the LED lamp 10 is used, the photo-resistor RF can sense a luminous intensity of the LEDs 13 of the LED lamp 10. The photo-resistor RF has a characteristic that when the luminous intensity of the LED lamp 10 has been reduced beyond a predetermined range, a resistance thereof increases in a proportion to the decrease of the luminous intensity. The voltage regulator 21 includes an output terminal 210 for outputting the electric current to the LEDs 13 of the LED lamp 10 and a feedback terminal 212.

The feedback circuit 25 includes an amplifier 251, a first resistor R1 and a second resistor R2. The amplifier 251 includes an in-phase input end 253, an out-phase input end 255 and an output end 256. The LEDs 13 of the LED lamp 10 and the second resistor R2 are connected in series between the output terminal 210 of the voltage regulator 21 and the ground. A first junction 30 is formed between the LEDs 13 and the second resistor R2. That is, the LEDs 13 are connected between the output terminal 210 of the voltage regulator 21 and the first junction 30, whilst the second resistor R2 is connected between the first junction 30 and the ground. The in-phase input end 253 of the amplifier 251 is connected to the first junction 30. The first resistor R1 and the photo-resistor RF are connected in series between the output end 256 of the amplifier 251 and the ground. A second junction 40 is formed between the first resistor R1 and the photo-resistor RF. The out-phase input end 255 of the amplifier 251 is connected to the second junction 40. That is, the first resistor R1 is connected between the output end 256 and the second junction 40, and the photo-resistor RF is connected between the second junction 40 and the ground. The output end 256 of the amplifier 251 is directly connected to the feedback terminal 212 of the voltage regulator 21.

According to a characteristic of the amplifier 251, the electric current $I_F$ through the LEDs 13 should satisfy the following equation:

$$I_F = \frac{V_T}{r2} = \frac{V_{FB}}{r2} * \left(\frac{rF}{r1 + rF}\right),$$

Wherein $V_T$ is a voltage at the in-phase input end 253 of the amplifier 251, $V_{FB}$ is a voltage at the output end 256 of the amplifier 251, r1 is a resistance of the first resistor R1, r2 is a resistance of the second resistor R2, and rF is a resistance of the photo-resistor RF. According to the equation, the electric current $I_F$ is increased when the resistance rF of the photo-resistor RF is increased. When used, the photo-resistor RF senses the light intensity of the LED lamp 10 and the resistance rF of the photo-resistor RF increases along with a decrease of the light intensity of the LED lamp 10 when the light intensity of the LED lamp 10 is below a predetermined range. The change of the resistance rF of the photo-resistor RF is fed back to the voltage regulator 21 via the amplifier 251, to thereby control the electric current $I_F$ flowing through the LEDs 13. Thus the electric current $I_F$ is increased when the light intensity of the LED lamp 10 is decreased, to thereby maintain the light intensity of the LED lamp 10 within an acceptable range.

A working principle of the control circuit 20 will hereinafter be explained in a greater detail. Supposing that the LED lamp 10 without the control circuit 20 has a life time of about one thousand hours. During the life time, the luminous intensity of the LED lamp 10 maintains within the acceptable range to satisfy lighting needs for use. After the life time, due to the luminous decay generated by the LEDs 13, the luminous intensity of LED lamp 10 is reduced to below a lowest limit of the acceptable range and no longer satisfies the lighting needs.

When the LED lamp 10 having the control circuit 20 is used, at a beginning of the life time, no luminous decay is generated by the LEDs 13, an initial electric current is supplied by the voltage regulator 21 to the LEDs 13 to ensure the luminous intensity of the LED lamp 10 being the rated current which is large enough to satisfy the lighting needs. At this moment, the luminous intensity of the LED lamp 10 is nearly constant, and the photo-resistor RF has an initial resistance which is so little that it hardly affects the electric current $I_F$. During the life time, the luminous intensity of the LED lamp 10 is gradually reduced with an increased usage time due to the luminous decay of the LEDs 13 but maintains within the acceptable range. The decrease of the luminous intensity of LED lamp 10 is also within the predetermined range, such that the luminous intensity of the LED lamp 10 is always strong enough and the photo resistor RF maintains at the initial resistance. After the life time, due to the luminous decay of the LEDs 13 is further increased, the luminous intensity of the LED lamp 10 is decreased beyond the predetermined range.

At this moment, the photo-resistor RF senses the decrease of the luminous intensity of the LED lamp 10, and the resistance rF of the photo-resistor RF increases proportionally along with the decrease of the light intensity of the LED lamp 10. According to the equation above, when the resistance rF of the photo-resistor RF is increased, the voltage regulator 21 outputs an electric current larger than the initial electric current to drive the LEDs 13 to emit more light, to thereby enhance the light output of the LEDs 13. The luminous intensity of the LED lamp 10 is accordingly increased to satisfy the lighting needs again. At this time, the resistance of the photo-resistor RF is slightly larger than the initial resistance, and the luminous intensity of LED lamp 10 is slightly weaker than the luminous intensity at the beginning of the life time but still within the acceptable range to satisfy the lighting needs. Accordingly, the LED lamp 10 can be continuously used for an extra period of time to thereby prolong the life time thereof.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A control circuit adapted for controlling an electric current to an LED of an LED lamp, comprising:

a voltage regulator comprising an output terminal for coupling to an input end of the LED thereby providing the electric current to the LED and a feedback terminal;

a feedback circuit comprising an amplifier, the amplifier comprising an in-phase input end, an out-phase input end and an output end, the in-phase input end being adapted for coupling to an output end of the LED, the output end of the amplifier being connected to the feedback terminal of the voltage regulator; and a photo-resistor being connected between the out-phase input end of the amplifier and ground;

wherein the photo-resistor senses a change of a light intensity of the LED of the LED lamp and has a resistance increasing along with a decrease of the light intensity of the LED of the LED lamp, the increase of resistance of the photo-resistor being fed back to the voltage regulator via the amplifier, to thereby control the electric current to the LED to be increased so that the light intensity of the LED lamp is maintained within an acceptable range.

2. The LED lamp control circuit as described in claim 1, wherein the feedback circuit further comprises a resistor being connected between the out-phase input end and the output end of the amplifier.

3. The LED lamp control circuit as described in claim 2, further comprising another resistor being connected between the in-phase input end and the ground.

4. An LED lamp comprising:

a voltage regulator comprising an output terminal and a feedback terminal;

an amplifier comprising an in-phase input end, an out-phase input end and an output end, the output end of the amplifier being connected to the feedback terminal of the voltage regulator;

at least one LED being connected between the in-phase input end of the amplifier and the output terminal of the voltage regulator; and a photo-resistor being connected between the out-phase input end of the amplifier and ground;

wherein the photo-resistor senses a change of a light intensity of the at least one LED of the LED lamp and has a resistance increasing along with a decrease of the light intensity of the at least one LED of the LED lamp, and the increase of resistance of the photo-resistor is fed back to the voltage regulator via the amplifier, to thereby control an electric current flowing through the at least one LED to be increased to maintain the light intensity of the at least one LED of the LED lamp within an acceptable range.

5. The LED lamp as described in claim 4, wherein the LED lamp further includes a lampshade covering around the at least one LED, the photo-resistor mounted on an inner surface of the lampshade.

6. The LED lamp as described in claim 4, further comprising a resistor being connected between the out-phase input end and the output end of the amplifier.

7. The LED lamp as described in claim 6, further comprising another resistor being connected between the in-phase input end of the amplifier and the ground.

* * * * *